United States Patent [19]

Tyree, Jr.

[11] 4,165,618

[45] Aug. 28, 1979

[54] TREATMENT WITH LIQUID CRYOGEN

[76] Inventor: Lewis Tyree, Jr., 145 Briarwood Ave., North, Oak Brook, Ill. 60521

[21] Appl. No.: 899,410

[22] Filed: Apr. 24, 1978

[51] Int. Cl.[2] ..... F25D 17/02

[52] U.S. Cl. ..... 62/64; 62/375; 62/376; 131/133 R; 131/140 A; 131/140 B

[58] Field of Search ..... 131/140 A, 140 B, 120, 131/133 R, 133 A, 135, 136; 62/63, 64, 374, 375, 376

[56] References Cited

U.S. PATENT DOCUMENTS

| | | | |
|---|---|---|---|
| 3,754,407 | 8/1973 | Tyree, Jr. | 62/63 |
| 3,889,488 | 6/1975 | Maeda et al. | 62/374 |
| 3,892,104 | 7/1975 | Klee et al. | 62/374 |
| 4,075,869 | 2/1978 | Fitsall | 62/374 |
| 4,086,783 | 5/1978 | Wagner | 62/374 |
| 4,086,784 | 5/1978 | Wagner | 62/374 |

*Primary Examiner*—Ronald C. Capossela

*Attorney, Agent, or Firm*—Fitch, Even & Tabin

[57] ABSTRACT

A product, such as tobacco, is introduced into a processing chamber that is coupled with a holding chamber. A cryogen vapor pressure is established in the processing chamber, and a compressor is operated to transfer liquid cryogen near equilibrium conditions by differential pressure flow from the holding chamber to the processing chamber and, after treatment, and for returning liquid cryogen by differential pressure flow back to the holding chamber. Pressure in both chambers is maintained above the saturation pressure whenever differential pressure transfer occurs. Vapor from the processing chamber is recovered in first, second and third gas receivers which are respectively interconnected by a low-pressure compressor and a high-pressure compressor. After treatment, a processing chamber is sequentially interconnected with the first receiver, then with the second gas receiver and subsequently with the third gas receiver.

17 Claims, 1 Drawing Figure

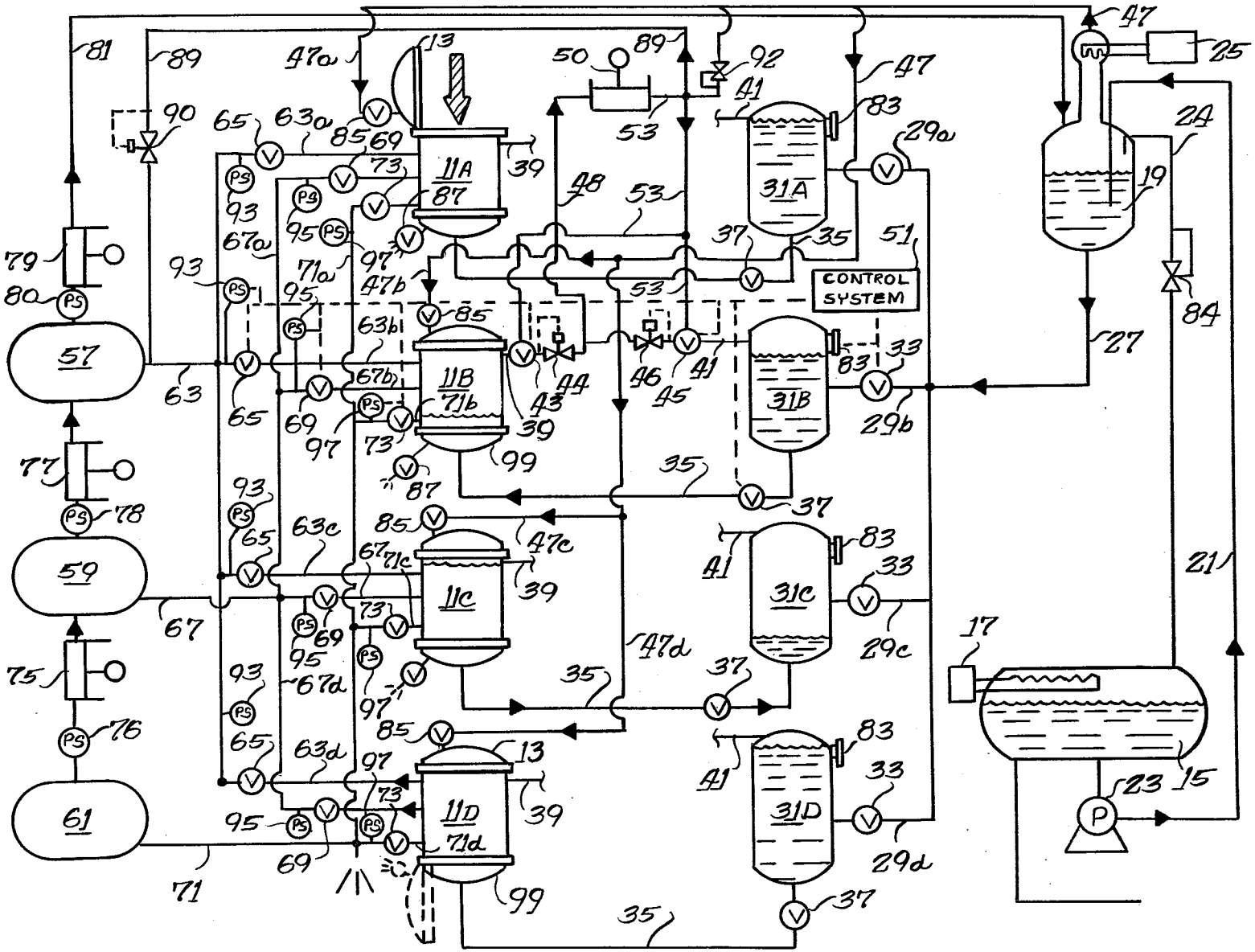
CONTROL SYSTEM

TREATMENT WITH LIQUID CRYOGEN

This invention relates to treatment of products with a liquid cryogen, and more particularly to methods and apparatus for using a liquid cryogen to treat a product, usually by immersion therein.

The use of liquid cryogens for refrigeration and other treatment of products has increased significantly with the increase in availability of cryogens. As a result, new uses for cryogens are being investigated, and such uses are beginning to have commercial applications. For example, one fairly recently discovered use involves naturally occurring plants, particularly those of a leafy variety, such as tobacco. It has been found that by saturating the pores of such plants with a liquid cryogen under high pressure, the physical structure of the product can be favorably altered by causing the cryogen which fills the pores to rapidly expand and thus create a large volume of gas which has a stretching effect upon the plant material and results in a physically expanded product.

There are many problems associated with the handling of cryogens at high pressures and particularly at temperatures which may approach the critical temperature of the particular cryogen. Accordingly, one objective of the invention is to provide improved handling methods for liquid cryogens during the treatment of products, which cryogens may be at elevated pressures and at equilibrium temperatures that may approach the critical temperature. As a result of the growing cost of energy, it has also become important to minimize the expenditure of cryogens whenever feasible, and another objective of the invention is to provide an efficient arrangement for recovering cryogen vapor in large quantities, particularly without adversely affecting an overall treatment process wherein such vapor is being generated. Still another objective is to prevent any substantial leaching of soluble products from tobacco.

The invention provides a process for treating various products with a liquid cryogen which is particularly advantageous under conditions where the liquid is at or near equilibrium conditions and which can be employed even when the temperature of the liquid cryogen approaches its critical temperature. The invention, when used to treat tobacco, minimizes leaching of tobacco components because reuse of the same liquid quickly achieves an equilibrium balance which remains in the liquid cryogen. In addition, the invention provides an improved process and apparatus for recovering large quantities of cryogen vapor, the generation of which accompanies treatment of the product, using a plurality of gas receivers that are maintained at different predetermined pressures by means of multiple compressors. The overall system accomplishes efficient, fast recovery of cryogen vapor which can then be reliquified and reused.

The above-mentioned and other objectives of the invention will be apparent from the following detailed description of a preferred embodiment thereof, when read in conjunction with the accompanying drawing of a diagrammatic representation of a representative installation.

In the illustrated installation there are four treatment or processing chambers shown 11A, 11B, 11C and 11D, each of which is provided with an upper opening through which the product to be treated can be supplied. In the illustrated embodiment, each treatment chamber 11 is provided with a hinged lid 13 through which the material can be added, as by gravity-feed from a conveyor (not shown) or the like. The treatment chamber 11 may be sized to accept, for example, a charge of 250 pounds of a plant product having pores into which a liquid cryogen can penetrate, such as tobacco or some other leafy product which might be used as a tobacco substitute. Following entry of the tobacco, the upper lid 13 is closed and clamped shut to provide a pressure-tight enclosure wherein the treatment will occur.

The liquid cryogen which is used may be any of those cryogens which are practically available, for example, nitrogen, oxygen, argon, hydrogen, helium, methane, freons, carbon monoxide and carbon dioxide. If the product being treated is a food product or some similarly related product, for example, a tobacco product, a cryogen is chosen which would be in no way deleterious in order to meet all health standards. For food and tobacco products as well as other products, the preferred cryogen is carbon dioxide, which has a triple point at about 75 psia and −70° F. (−56.7° C.) and a critical temperature of about 88° F. (31° C.). One particular advantage of carbon dioxide lies in the fact that its working temperature lies within a fairly moderate range. Thus, exposure of the product to ultralow temperatures is avoided, and the problems of insulation are substantially lessened. Carbon dioxide also has advantages growing from its solvent characteristics.

The pumping of a liquid cryogen at or near equilibrium conditions at a predictable flow rate is an extremely difficult task. In order to accomplish the efficient treatment of large quantities of product, for example individual charges of 250 pounds or more, on a production-line basis, it is necessary to rapidly transfer large quantities of liquid cryogen.

In the illustrated installation, a standard carbon dioxide liquid storage vessel 15 is depicted that is designed for the storage of liquid carbon dioxide at about 315 psia, which has an equilibrium temperature of about 0° F. A refrigeration unit 17, such as a freon condenser, is associated with the storage vessel 15 and is designed to operate as needed to condense carbon dioxide vapor in the vessel to liquid. The freon condenser 17 is a standard item, and one is employed with a sufficient condensation capacity to match the size of the tank and the indicated operations for the overall installation. In many plants, the carbon dioxide storage vessel 15 will serve more than one processing unit and may be used for different purposes.

An intermediate vessel 19 acts as a reservoir to serve the specific treatment installation here of interest, and it is connected by a liquid line 21, which includes a high-pressure pump 23, to the liquid side of the storage vessel 15. A vapor inter-connection 24 between the two vessels 15,19 is also provided, as well as a liquid level control (not shown) that would cause the pump 23 to operate to maintain the level of liquid in the intermediate vessel 19 between desired upper and lower limits. The intermediate vessel 19 may be maintained at any desired elevated pressure, and for carbon dioxide this may be about 915 psia. The intermediate vessel 19 is provided with its own freon condenser 25 which is employed to condense the vapor which is recovered from the treatment chambers 11. As a result, the liquid cryogen associated with the four-chamber arrangement is confined within a substantially closed system, and the storage vessel 15 merely provides makeup liquid cryogen to the intermediate vessel 19 to replenish the amount which is expended during the treatment steps.

A liquid supply line 27 leads from the bottom of the intermediate tank 19 to a manifold which splits the flow into a separate feed line 29*a, b, c* and *d* leading to four separate holding chambers 31A, 31B, 31C and 31D, each of which is interconnected with one of the four treatment chambers as a cooperative set. Appropriate check valves and manually operable valves are included in the liquid supply lines 29 which are not shown in the simplified drawing. A remote-controlled valve 33 is included in each one of the feed lines 29; however, for purposes of simplification, the valves 33 and the various valves to be described hereinafter are only illustrated with respect to the second set which includes treatment chamber 11B and holding tank 31B.

A liquid transfer line 35 interconnects the lower portions of each pair of treatment chambers 11 and holding chamber 31, and a remote-controlled valve 37 is contained in the line 35. A vapor line 39 is connected to the top of each treatment chamber 11, and a vapor line 41 connects to the top of each holding chamber 31. The vapor line 39 is branched at a three-port, three-position remote-controlled valve 43, and one branch contains a back-pressure regulator 44. The vapor line 41 is likewise branched at a three-port, three-position remote-controlled valve 45, and again one branch contains a back-pressure regulator 46. The valves associated with each set of chambers are connected to a control system 51. A purge gas line 47 is provided which is branched, and each branch 47*a, b, c* and *d* connects to one of the treatment chambers 11 at an upper location therein. Each purge line contains a suitable check valve (not shown) and a control valve described hereinafter.

The branches of the vapor lines 39,41 containing the pressure-regulators 44,46 are manifolded downstream thereof to a suction line 48 which connects to the intake of a compressor 50. The compressor 50 employs accumulators (not shown) adjacent its intake and discharge, as is standard practice. The other branches of the vapor lines 39,41 are also interconnected to a line 53 leading from the discharge side of the compressor 50. Accordingly, vapor can be withdrawn from either the treatment chamber 11 or the holding chamber 31 in any set through one of the valves 43,45 via the pressure-regulator, and the higher pressure vapor from the compressor will simultaneously be applied to the other chamber of the set through the other valve.

To recover the vapor from the treatment chambers 11 following the treatment of the product with liquid cryogen, three separate gas receivers 57,59,61 are provided. The high pressure gas receiver 57 is connected by an inlet line 63 which contains a check valve, and this line is branched so that an individual line 63*a, b, c, d* leads to each of the four treatment chambers. In an actual installation, the lines 63 (as well as the lines leading to the rest of the gas receivers) would likely be connected to the vapor outlet 39; however, the illustrated arrangement affords a clearer explanation of the sequence. Each branch 63 includes a remote-controlled valve 65. Similarly, the intermediate pressure gas receiver 59 is connected to an intake line 67 containing a check valve and by branches 67*a, b, c, d* to each of the four treatment chambers 11. Each of the four branches contains a remote-controlled valve 69. The lower pressure gas receiver 61 is likewise connected by an intake line 71 containing a check valve to four branch lines 71*a, b, c, d* which lead to each of the four treatment chambers, and each branch line contains a remote-controlled valve 73. All of the remote-controlled valves are respectively electrically interconnected to the control system 51 for the particular set.

A compressor 75 takes its suction from the low pressure gas receiver 61 and discharges to the intermediate pressure gas receiver 59. This compressor 75 can be suitably controlled via a pressure switch 76 to operate so long as the pressure in the low pressure gas receiver exceeds a predetermined minimum, for example 30 psia when the cryogen is carbon dioxide. Another compressor 77, which may be a single-stage compressor, takes its suction from the intermediate pressure gas receiver 59, discharges into the high pressure gas receiver 57, and is controlled by a pressure switch 78. This compressor 77 may be set to run so long as the gas pressure exceeds a higher minimum, for example about 110 psia when the cryogen is $CO_2$. A third compressor 79 takes its suction from the high pressure gas receiver 57 and discharges to a vapor return line 81 leading to the intermediate tank 19 where the vapor is condensed to liquid by the condenser 25. This compressor 79 is controlled by a pressure switch 80 and may be set to run so long as the pressure in the gas receiver 57 exceeds about 250 psia, when the cryogen is $CO_2$; however, the compressor 79 must be capable of raising the pressure to about 915 psia.

It is believed that the operation of the installation can be best understood by describing one complete cycle of operation. The four sets of treatment chambers 11 and holding chambers 31 are depicted as being in four different stages of sequential operation, as exemplary of the intention that overall operation of the installation would be coordinated so that each set would be in a different phase. For example, the uppermost set illustrates essentially the product-loading step, and the next set below illustrates the treatment-chamber-filling step. The next lower set illustrates the treatment-chamber-emptying step; whereas the lowermost set illustrates the vapor recovery phase, as well as the product-discharge step in dotted outline. It is practical to impregnate approximately 250 pounds of a pore-containing plant material, such as tobacco, with liquid carbon dioxide at approximately 900 psia in an overall cycle time of about 15 minutes. Accordingly, it would be understood that each of the treatment chambers 11 would be filled with a fresh charge of product about every 15 minutes, while the other three treatment chambers are at successively different stages of operation, as generally depicted in the drawing. With $CO_2$ as the cryogen, operation is considered practical at equilibrium conditions at pressures between about 350 psia and the critical pressure of about 1066 psia; however, preferably, operation is carried out at an impregnation pressure of between about 450 psia and about 950 psia.

When the lid 13 is open and the product is being loaded into the treatment chamber 11, the control system 51 will allow the fill valve 33 to open and apply additional liquid cryogen to the holding chamber 31 if called for by a liquid level control 83 associated with each chamber 31. The pressure within the intermediate vessel 19 may be maintained at about 915 psia by the high pressure pump 23,24 by an appropriate setting on a valve 84 in the vapor line which interconnects the vessels 15,19 and if necessary by heat addition to the vessel 19. Liquid flow into the holding chamber 31 is accomplished by differential pressure, with the vapor which is displaced being withdrawn through the line 41 via the pressure regulator 46 and then compressed by compressor 50. Following closing and latching of the upper lid 13, the treatment chamber is purged of air by a timed flow of high pressure $CO_2$ vapor. The control system 51 opens a valve 85 in a branch of the purge line 53 for a predetermined amount of time, for example, about a minute. Prior to purging, the treatment chamber 11 may be optionally evacuated by interconnecting it with a vacuum chamber (not shown) which is maintained at a desired low pressure by a vacuum pump (not shown). At the time of purging, a valve 87 in a vent line connected to each chamber is opened to allow the high pressure $CO_2$ purge vapor to escape to the atmosphere. For clarity, purging is depicted as occurring from top to bottom; however, because $CO_2$ is heavier than air, it is usually injected at the bottom and vented at the top.

Following purging for the predetermined time, the valve 87 leading to the vent is closed and a short time later the valve 85 is closed after pressurizing the treatment chamber to about 915 psia, i.e., the pressure of the intermedite storage vessel 19. With the pressurization complete, the valve 37 in the liquid transfer line 35 is opened, and the valve 45 is set to connect the vapor line 41 leading to the holding chamber 31 to the compressor discharge. The compressor 50 runs whenever there is a minimum gas pressure at its suction side and discharges into the line 53. A branch line 89 leads from the line 53 through a back-pressure regulator 90 into the high pressure accumulator 57. The back-pressure regulator 90 is set at about 50 psi above the pressure regulators 44,46 and provides a place for the compressor to discharge should an unexpected pressure build-up occur in the compressor circuit. A desired minimum pressure is maintained in the line 53 by a connection to the vapor line 47 from the vessel 19 through a pressure-regulator 92 which opens should the pressure drop below a set value.

Operation of the valve 43 in conjunction with valve 45 applies the higher gas pressure from the compressor 50 to the holding chamber 31 while the suction side of the compressor is connected to the treatment chamer 11 via the pressure regulator 44, which is preset to maintain a minimum pressure of about 920 psia in the treatment chamber so that the incoming liquid does not flash to vapor. The result is that the liquid cryogen in the holding chamber 31 is caused to rapidly flow out the bottom, through the liquid transfer line 35, and fill the treatment chamber 11.

The transfer of liquid can be monitored in various ways. For example, the liquid level in the chamber 31 can be measured, or alternatively the control system 51 may be set up to allow a timed transfer of liquid cryogen between the two chambers. For instance, if a 250 pound charge of tobacco is to be impregnated, it may be desired to transfer approximately 600 pounds of liquid carbon dioxide at about 900 psia. Once transfer has been made, the valves 37,43 and 45 are closed, and the tobacco is allowed to soak in the 900 psia liquid cryogen for a desired amount of time, e.g., about three minutes. The filling of the treatment chamber with liquid from the holding chamber is depicted in the set of chambers just below the uppermost set in the drawing.

Following the soaking, the liquid cryogen is removed from the treatment chamber and returned to the holding chamber, which sequence is depicted generally in the next lower set although the vapor-valving arrangement is not repeated so reference must be made to the next upper set. The control system 51 operates the valve 43 to connect the vapor line 39 to the line 53 leading from the discharge side of the compressor 50 and the valve 45 to connect the line 41 through the regulator 46 to the line 48 leading to the suction side. At the same time, the valve 37 in the liquid transfer line 35 is opened. As a result, the compressor 57 takes its suction from the holding chamber 31 through the back pressure regulator 46, which may be set at about 920 psia, and applies the higher pressure gas to the top of the treatment chamber 11, causing the liquid cryogen to reverse its earlier flow and flow from left to right through the liquid transfer line 35 back into the holding chamber 31. Liquid removal is rapidly accomplished in about a minute and one-half, and flashing of liquid to vapor is prevented by the back-pressure regulator 46. Carry-over of liquid through the vapor line 41 is avoided by locating the vapor lines in the upper ends of the holding chambers 31 and by closing the valves 43,45 and 37 as soon as the control system detects that there is no longer liquid flowing in the line 35, as by receiving a signal from a liquid flow sensor (not shown) or some similar sensor.

Following closing of the valves 43,45 and 37, the valve 65 in the vapor removal line 63 is opened to connect the treatment chamber 11 with the highest pressure gas receiver 57. A differential pressure switch 93 measures when the pressure has equalized to within about 5 psi and notifies the control system 51 to close the valve 65 and open the valve 69 in the intermediate line 67 to now interconnect the treatment chamber 11 with the gas receiver 59. After the pressures have again equalized so that the pressure in the treatment chamber has dropped to about 175 psia, a differential pressure switch 95 causes the control system 51 to close the valve 69 and open the valve 73 in the line 71 leading to the lowest pressure gas receiver 61. After the pressure in the treatment chamber 11 equalizes at about 50 psia, a differential pressure switch 97 causes the control system to close the valve 73. In order to coordinate the different sets of chambers, it is important that the liquid transfer steps be achieved at a desired flow rate so that the particular transfer can be reliably effected within a precise predetermined length of time.

The control system 51 recognizes, from the closing of valve 73, that vapor recovery is completed and automatically opens the valve 87 in the vent line to allow the treatment chamber 11 to return to atmospheric pressure by venting the remainder of the carbon dioxide vapor to the atmosphere. Inasmuch as some of the carbon dioxide will have changed to carbon dioxide snow which will be slowly subliming, the valve 87 in the vent line is left open to assure that complete depressurization has occurred. The treatment chamber 11 is provided with a hinged bottom 99 similar to the hinged top, and the bottom is unlatched allowing the tobacco to be removed by gravity, as depicted in dotted lines in the lowermost set. It falls onto a conveyor or the like where the remainder of the carbon dioxide snow in the pores will continue to sublime. Examination of the tobacco leaves shows that the bulk has been increased as a result of the expansion that has taken place within the pores of the plant.

Because a certain amount of liquid cryogen will be used in each impregnation cycle, although certainly the major portion of the liquid cryogen will be returned to the holding chamber 31, the control system 51 has the time from the beginning of the gas recovery step through the filling of the treatment chamber 11 with the next charge of product to refill the holding chamber 31 with liquid cryogen as necessary. Because it is recognized that liquid cryogens can also serve as solvents to leach substances from the product being treated, even though they are otherwise chemically inert to the products being treated, it is felt important that the liquid cryogen be reused in a manner which prevents any dissolved substances from plating out so that any substances so leached will build up and stabilize in the liquid cryogen. As a result, further extraction from the products being treated is minimized.

The vapor recovery system provides a particularly effective and efficient method of removing the vapor from the treatment chamber 11 in a short period of time and recompressing the vapor to facilitate its return into the overall cryogen treatment system. The gas receivers 57,59,61 in effect act as accumulators, and the pressure therein will vary within certain limits. It is contemplated that the system will be sized so that the compressors 75,77 and 79 will run continuously whenever product treatment is being carried out. Accordingly, these compressors are preferably single-stage and individually sized so as to best operate within the pressure ranges contemplated; however, they could be portions of a single, multistage compressor driven from a common source of power.

The compressor 50 which serves to control the pressure in the treatment and holding chambers and to create the desired transfer of liquid therebetween by differential pressure is also preferably provided with adjacent accumulators (not shown) which allow it to run substantially continuously and to rely upon the operation of the valves to accomplish fluid flow in the desired directions.

Although the invention has been described with regard to the presently preferred embodiment, which illustrates an overall very high pressure carbon dioxide system for impregnating tobacco, it should be understood that various modifications and changes as would be obvious to one having the ordinary skill in the art may be made without departing from the scope of the invention which is defined solely by the claims appended hereto. For example, the storage vessel 15 and the intermediate tank 19 could be combined into a single unit if, for example, this were the only installation in a plant which utilized liquid carbon dioxide. Moreover, if the treatment were carried out at a lower pressure, satisfactory vapor recovery might be effected with only two receivers and two vapor-recovery compressors. Various of the features of the invention are emphasized in the claims which follow.

What is claimed is:

1. Apparatus for processing a product by treatment with a liquid cryogen at or near equilibrium conditions, which apparatus comprises a processing chamber having opening means through which the product to be treated can be introduced and withdrawn, means for supplying cryogen vapor under superatomospheric pressure, a holding container for liquid cryogen, conduit means interconnecting said holding chamber and said processing chamber, control means for establishing a cryogen vapor pressure in said processing chamber which is about the desired pressure, means for supplying said holding chamber with liquid cryogen, a compressor, means for operating said compressor to transfer liquid cryogen by differential pressure flow from said holding chamber to said processing chamber for treatment of said product and for transferring liquid cryogen by differential pressure flow from said processing chamber back to the holding chamber at the conclusion of such treatment, and means for assuring that the pressure in said holding chamber and the pressure in said processing chamber both remain above the saturation pressure at any time when said differential pressure transfer of liquid cryogen is occurring.

2. Apparatus in accordance with claim 1 wherein a liquid cryogen storage vessel is provided and wherein means is provided for automatically supplying make-up cryogen to said holding chamber to compensate for cryogen expended during treatment.

3. Apparatus in accordance with claim 1 wherein said control means is adapted to create a purge flow of cryogen vapor through said processing chamber prior to said pressurizing.

4. Apparatus in accordance with claim 1 wherein remote-control valve means is provided between the discharge side of said compressor and each of said chambers and wherein back-pressure regulator means is provided between each of said chambers and the suction side of said compressor.

5. Apparatus in accordance with claim 1 wherein compressing and condensing means is provided and is automatically interconnected to said processing chamber following the transfer of liquid cryogen out of said processing chamber and effects withdrawal and recovery of cryogen vapor therefrom.

6. Apparatus in accordance with claim 5 wherein said compressing and condensing means includes first, second and third gas receivers, high-pressure compressor means and low-pressure compressor means, said low-pressure compressor means being connected to take suction from said third receiver and to discharge to said second receiver, and said high-pressure compressor means being connected to take suction from said second receiver and to discharge to said first receiver, and wherein means is provided to sequentially interconnect said processing chamber to said first receiver, then to said second gas receiver and subsequently to said third gas receiver.

7. Apparatus in accordance with claim 6 wherein said compressor means are single-stage compressors.

8. Apparatus in accordance with claim 6 wherein differential pressure sensing means is provided to effect said sequential interconnections.

9. A process for treating a product with a liquid cryogen at or near equilibrium conditions, which process comprises introducing the product to be treated into a processing chamber, establishing an initial pressure in the processing chamber which is about the desired processing pressure, providing a reservoir of liquid cryogen in a holding chamber, interconnecting said chambers for fluid flow therebetween;

operating a compressor to withdraw vapor from said processing chamber and to apply compressed vapor to said holding chamber to thereby transfer liquid cryogen from the holding container to the processing chamber, and thereafter returning liquid cryogen from the processing chamber to the holding chamber by withdrawing vapor from said holding chamber and applying compressed vapor to said processing chamber.

the pressure in the holding chamber and the pressure in the processing chamber being maintained at or above the saturation pressure at all times during transfer of liquid cryogen therebetween.

10. A process in accordance with claim 9 wherein the product being treated is tobacco.

11. A process in accordance with claim 9 wherein said cryogen is $CO_2$.

12. A process in accordance with claim 11 wherein said liquid $CO_2$ is maintained at a pressure of between about 450 psia and about 950 psia during said transfer.

13. A process in accordance with claim 9 wherein cryogen vapor is removed from the processing chamber and recovered prior to withdrawal of said treated product therefrom by interconnecting the processing chamber and a first receiver in fluid communication and substantially equalizing pressure therebetween, thereafter interconnecting the processing chamber and a second lower pressure gas receiver and substantially equalizing pressure therebetween, subsequently interconnecting said processing chamber and a third still lower pressure gas receiver and substantially equalizing pressure therebetween, sucking vapor from the third receiver, compressing said vapor and discharging same to the second receiver, and sucking vapor from the second receiver, compressing said vapor and discharging same to the first receiver.

14. A process in accordance with claim 13 wherein the product being treated is a plant having pores into which said liquid cryogen penetrates.

15. A process in accordance with claim 14 wherein said product is tobacco and said cryogen is $CO_2$.

16. A process in accordance with claim 13 wherein said liquid cryogen is supplied from a storage vessel to the holding chamber and wherein said vapor from said first gas receiver is compressed and returned to the storage vessel.

17. A process in accordance with claim 16 wherein said compressed vapor is used to purge atmospheric air from said processing chamber and to create said initial pressure therein.

* * * * *